United States Patent [19]

Lapointe et al.

[11] 4,422,270

[45] Dec. 27, 1983

[54] MODULAR, SELF SUPPORTING FLIGHT OF STAIRS

[75] Inventors: Leopold Lapointe, Val David; Donat Pelletier, St-Philippe, both of Canada

[73] Assignee: G.R.S. International Inc., Montreal, Canada

[21] Appl. No.: 340,891

[22] Filed: Jan. 19, 1982

[30] Foreign Application Priority Data

Jan. 21, 1981 [CA] Canada ..... 369021

[51] Int. Cl.[2] ..... E04F 11/00

[52] U.S. Cl. ..... 52/182

[58] Field of Search ..... 52/182–191

[56] References Cited

U.S. PATENT DOCUMENTS

| | | | |
|---|---|---|---|
| 2,593,683 | 4/1952 | Lyons | 52/182 |
| 2,724,466 | 11/1955 | Phillips | 52/182 |
| 2,760,239 | 8/1956 | Riley | 52/182 |
| 3,196,397 | 7/1965 | Goldstine et al. . | |
| 3,196,997 | 7/1965 | Hager | 52/182 |

FOREIGN PATENT DOCUMENTS

| | | |
|---|---|---|
| 872495 | 3/1979 | Belgium . |
| 600821 | 6/1960 | Canada . |
| 2753435 | 12/1979 | Fed. Rep. of Germany . |

*Primary Examiner*—James L. Ridgill, Jr.

*Attorney, Agent, or Firm*—Raymond A. Robic; Thierry Orlhac; Arthur Schwartz

[57] ABSTRACT

A modular, self supporting flight of stairs, comprising at least one pair of stringer units for supporting at least one step thread. Each stringer unit comprises a vertical side plate provided with an horizontal, upper flange and a vertical front plate defining with the side plate, a rectangular dihedron. This front plate is also provided with a horizontal, upper flange defining together with the upper flange of the side plate, a rigid, L-shaped support very stable in use for supporting one end of the thread. Each stringer unit also comprises a small, fixation plate integrally extending the side plate in the same plane as, or in a plane parallel to, the plane of the side plate. The stringer units of each pair are fixed to the corresponding units of a pair immediately superior or inferior thereto by riveting or bolting the fixation plates of one pair to the side plate of the other pair through a plurality of holes punched fixation plate and the lateral plate of the stringer units for receiving the bolts. This flight of stairs is particularly interesting because it has an excellent lateral stability due to the presence of the stabilizing front plates of each pair of stringer units on the upper flanges of which is fixed each thread, and because it also may support a very heavy load due to the punched holes used for riveting or bolting the stringer units together, the punching indeed providing some engagement of the holes one inside the other during the riveting or bolting step and thus ensuring an improved reinforcement of the flight against any vertical shearing force.

15 Claims, 10 Drawing Figures

MODULAR, SELF SUPPORTING FLIGHT OF STAIRS

BACKGROUND OF THE INVENTION (a) Field of the Invention

The present invention relates to a modular, self-supporting flight of stairs comprising at least two pairs of stringer units each acting as a support for a thread-step. The invention also relates to the stringer units used for the fabrication of this flight of stairs.

(b) Description of the Prior Art

Numerous modular, self-supporting flights of stairs of different structure are already known and commercially available in the market for arranging in a very fast manner, any king of building space comprising floors at different levels. Examples of such already known flights of stairs are disclosed and claimed in U.S. Pat. Nos. 2,593,683 of 1952; 2,724,466 of 1955; 2,760,239 of 1956 and 3,196,397 of 1965 and Canadian Pat. No. 600,821 of 1960.

If the flights of stairs disclosed in these patents all have the advantages of being of a relatively simple structure and therefore installable in a very fast manner even by a not specialized labor, however they all have also the drawback of being not very stable against lateral pressure because of the relative thinness of their stringers even when these stringers are provided with reinforcing flanges, and not very resistant with respect to the load they can support because each of their stringers is fixed to the stringer immediately inferior or superior thereto by means of bolts or rivets that are subject in use to very substantial shearing forces.

Thus, one can see that the bolts used for fixing the modular stringers of the flight of stairs disclosed in U.S. Pat. No. 2,593,683 are permanently subject to vertical shearing forces while the bolts used for fixing the modular stringers of the flight of stairs disclosed in U.S. Pat. Nos. 2,724,466 and 3,196,997 are also subject to shearing forces that are applied to the bolts in an inclined plane corresponding to the plane of the stairs. In a similar manner, the screws used for fixing the modular steps of the flight of stairs disclosed in U.S. Pat. No. 2,760,239 to their supporting, wood stringers are subject to vertical shearing forces as are the nails used for fixing the steps of the stairs disclosed in Canadian Pat. No. 600,821 to their wood stringers.

SUMMARY OF THE INVENTION

The object of the present invention is to provide the new type of stringer unit for the fabrication of a modular, self-supporting flight of stairs, whose structure advantageously permits to overcome the above mentioned drawbacks.

More especially, the object of the present invention is to provide a new type of stringer unit for the fabrication of a modular, self-supporting flight of stairs which, due to their "angular" structure, give an excellent lateral stability to the stairs fabricated therefrom and which, due to their installation by means of bolts or rivets passing through a plurality of punched holes that may fit one inside the other, substantially reduce the shearing forces undergone by the bolts or rivets in use and therefore give to the stairs fabricated therefrom an excellent ability of supporting any heavy load.

Another object of the present invention is to provide a modular, self-supporting flight of stairs comprising at least two pairs of stringer units of the above mentioned type, each pair acting as a support for a thread step.

The stringer unit for the fabrication of modular, self-supporting flight of stairs according to the invention comprises a vertical side plate provided with an horizontal upper flange, and a vertical front plate defining a rectangular dihedron with the side plate. The front plate is also provided with an horizontal, upper flange defining together with the upper flange of the side plate, a rigid L-shaped support very stable in use for supporting one end of the step thread.

Due to the very particular shape formed by the upper flanges of both sides plates, the stringer unit according to the invention gives an excellent lateral stability to the stairs once the flight has been erected, since each step is fixed not only by two parallel rows of nails or rivets at the vicinity of its ends but also by a third row of nails or bolts perpendicular to the two parallel rows.

The stringer unit according to the invention also comprises a small fixation plate integrally extending the side plate in the same plane as, or in a plane parallel to the plane of this side plate. This fixation plate is positioned so as to come into contact with the surface of the side plate of another, upper or lower stringer unit. The surface of the fixation plate and the surface of the side plate of the unit with which a fixation plate of a further, upper or lower stringer unit comes into contact, are each provided at least one punched hole positioned in such a manner as to be in front of a corresponding hole punched in the same direction through the surface of the fixation plate or the surface of the side plate of the further, upper or lower stringer unit for allowing fixation of both units together.

The fact that the holes used for fixing each stringer unit to the other stringer unit immediately superior or inferior thereto is punched, is of a great interest since it provides some engagement of the portion of the holes punched outwards one inside the other during the riveting and bolting step and thus an improved reinforcement of the flight of stairs against the vertical shearing forces. Indeed, it can be easily understood that the portions of the holes punched outwards that engage one inside the other, cooperate to support the load and to transmit this load directly to the side plate of the stringer units instead of transmitting it to the bolts or rivets passing through the holes. Accordingly, the bolts or rivets used for fixing the stringer units together are much less, and even no more, subject to vertical shearing forces.

In accordance with a preferred embodiment of the invention, the fixation plate integrally extends the rear upper end of the lateral side in a plane extending rearwardly, and parallel to the plane of the side plate. In this case, the fixation plate extends vertically above the upper edge of the side plate so as to come into contact with the surface of the lower front end of the stringer unit immediately superior thereto.

In accordance with another preferred embodiment of the invention, the fixation plate integrally extends the front lower end of the side plate in a plane extending rearwardly, and parallel to the plane of the side plate. In this case, the fixation plate extends in front of the side plate so as to come into contact with the surface to the rear upper end of the side plate of the stringer unit immediately inferior thereto, just under the upper flange thereof.

According to a further preferred embodiment of the invention, the stringer unit is made of two separate pieces vertically adjustable with respect to each other in order to allow adjustment of the total height of each step. This adjustment is obtained by a set of double slots provided in each piece and a pair of bolts and nuts screwed at an intersection of the sets of slots in order to connect both pieces together. The set of double slots of the upper piece extends in one inclined direction opposite to the direction of the set of double slots of the lower piece so that any movement of the bolts along one of slots in one direction is automatically compensated by a corresponding movement of the bolts in the other direction along the other set of double slots of the other piece.

The modular, self-supporting flight of stairs according to the invention comprises at least two pairs of stringer units as defined hereinabove. Each pair of stringer units acts as a support for a thread-step. The stringer units of each pair are fixed to the corresponding stringer units of the other pair which is immediately inferior or superior thereto by riveting or bolting the fixation plates of the units of one pair to the side plates of the units of the other pair, respectively.

According to a preferred embodiment of the invention, the flight of stairs further comprises two holding pieces each in the shape of a rectangular dihedron having one of their planes provided with at least one punched hole. These holding pieces are fixed by their planes provided with at least one punched hole, to the fixation plates or side plates of the stringer units supporting the upper step of the stairs. These holding pieces are especially used for firmly maintaining the upper end of the stairs onto a suitable support by fixation of their other planes onto this support. If this is necessary, a vertical connecting piece can be used between each holding piece and the support.

According to another preferred embodiment of the invention, the above described flight of stairs further comprises two reinforcing pieces having substantially the same shape as the above described, holding pieces. These reinforcing pieces can be fixed by riveting or bolting their planes provided with at least one punched hole to the fixation plates and side plates of two pairs of stringer units attached to each other for supporting two adjacent steps. These reinforcing pieces are advantageously used for laterally reinforcing the flight of stairs by fixation of their other planes to the ends of an horizontal rod or beam extending across, and under, the steps of the stairs.

Preferably, the stringer units of each pair are symetrical with respect to a vertical plane passing through the middle of the stairs. In this case, the front side of each unit preferably extends towards the middle of the stairs.

DRAWINGS

The general structure and the advantages of the stringer units and flight of stairs according to the invention will be better understood with reference to the following non restrictive description taken in connection with the accompanying drawings in which.

DESCRIPTION OF PREFERRED EMBODIMENTS OF THE INVENTION

Figure 1:
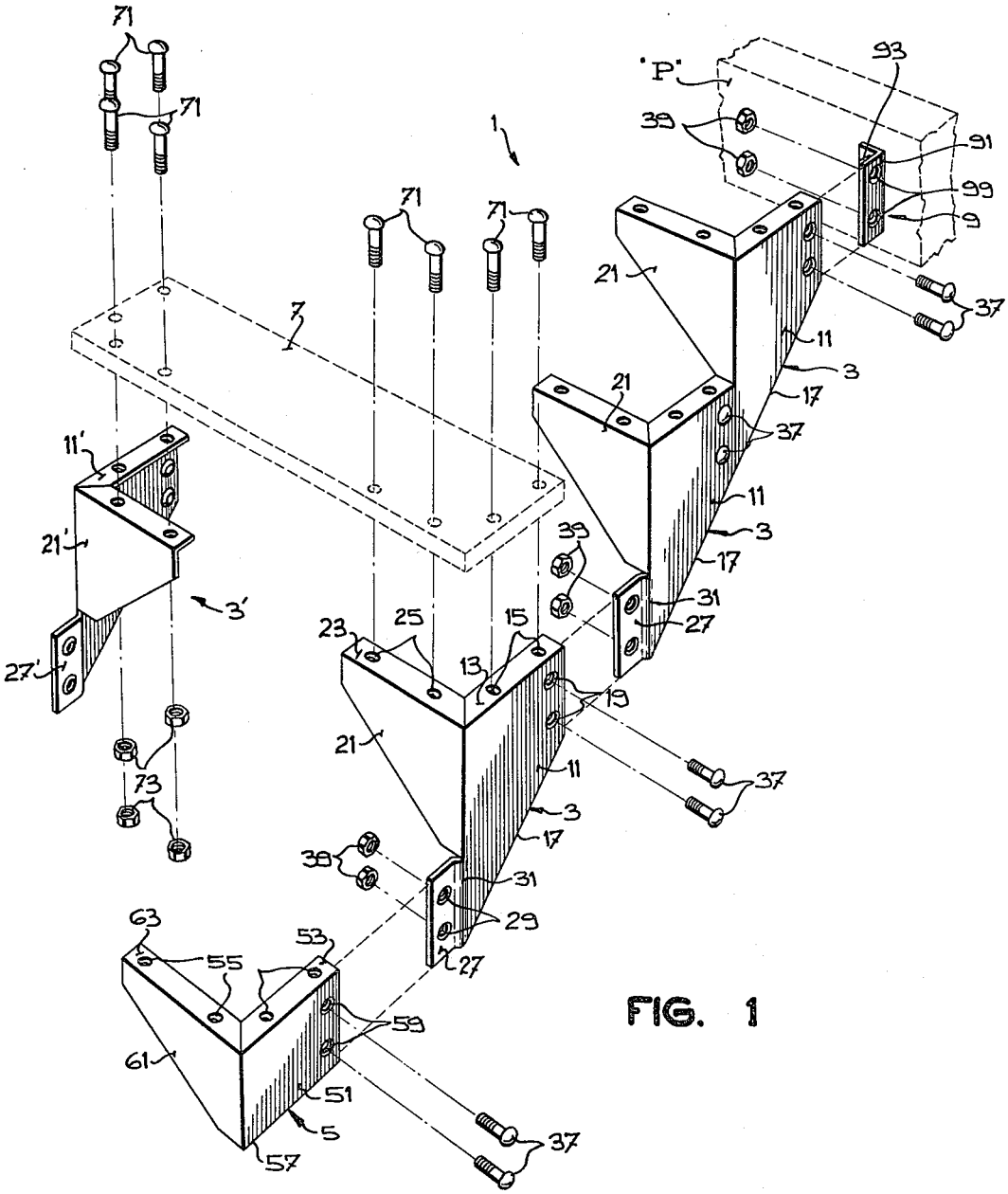
FIG. 1 is a semi-exploded, perspective view of a flight of stairs fabricated with a first embodiment of stringer units according to the invention.
Figure 2:
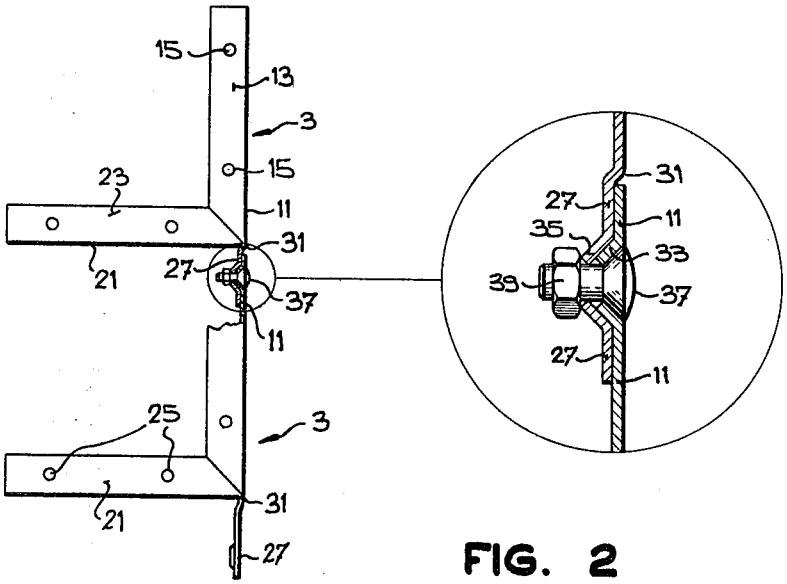
FIG. 2 is a cross-sectional, top plan view of two stringer units shown on FIG. 1, fixed to each other.
Figure 3:
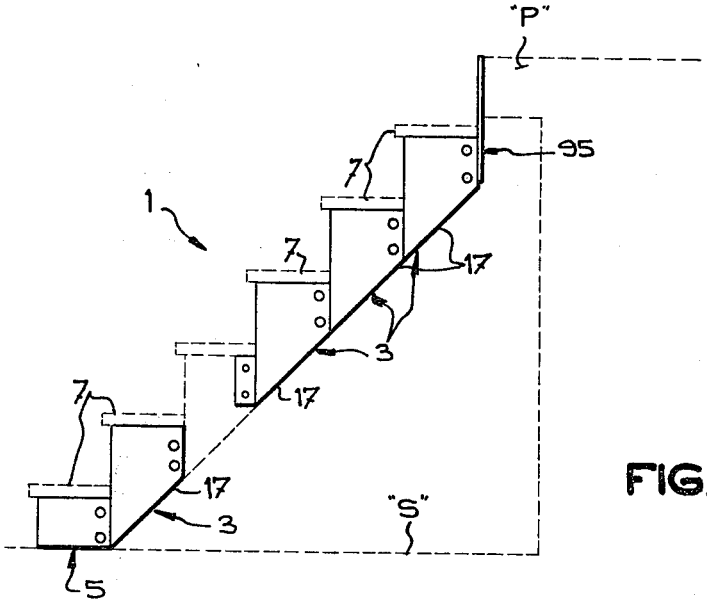
FIG. 3 is a side elevational view of the flight of stairs shown on FIG. 1, when use is made of a pair vertical connecting means for fixing the upper end of the stairs to a support.
Figure 5:
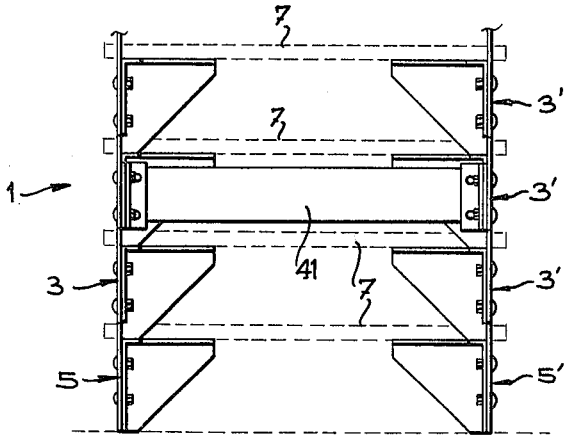
FIG. 5 is a rear elevational view of the flight of stairs shown on FIGS. 1 and 3, with a reinforcing rod to stabilize the stairs against lateral movement.

FIGS. 1, 3 and 5 of the drawings shown a flight of stairs 1 which is modular and self-supporting. The flight of stairs 1 is modular since it comprises a plurality of identical stringer units 3 acting as supports for a plurality of thread-steps 7. The flight of stairs 1 is also self-supporting since it does not require lateral beams for supporting its stringer units, the mere assembly of the modular units 3 all together being sufficient for giving enough rigidity to the stairs for supporting one or several persons going up or down the steps 7.

With particular reference to FIG. 1, the flight of stairs 1 comprises a first pair of stringer units 5 acting as support for the first step of the stairs, and a plurality of other pairs of stringer units 3 and 3' each acting as a support for a step from the first step to the floor P to which the stairs lead. The stringer units 3 and 3' of each pair are advantageously fabricated and orientated to be symmetrical with respect to a vertical plane passing through the middle of the stairs. It should be noted that this symmetrical arrangement is not essential since use could also be made of stringer units 3 and 3' that would be identical to each other instead of being symmetrical with respect to a vertical plane, with the same positive result although the general aspect of the stairs would be unbalanced.

Each stringer unit used for the fabrication of the flight of stairs 1 comprises a vertical side plate 11 provided with an horizontal, upper flange 13, and a vertical front plate 21 defining a rectangular dihedron with the side plate 11. The front plate 21 is also provided with an horizontal, upper flange 23 which extends in the same plane as the horizontal flange 13 of the side plate 11 in order to define together with this flange 13 a rigid, L-shaped support very stable in use and on which can be fixed one end of the step 7.

To facilitate the fixation of the step 7, the horizontal flanges 13 and 23 may comprise a plurality of holes 15 and 25 provided for receiving bolts 71 passing through the end of the step 7. The lower extremity of these bolts 71 can be screwed directly into the holes 15 and 25 if these holes are threaded or they can be fixed with nuts 73 as shown on FIG. 1.

Thanks to the L-shaped, horizontal support provided by each stringer unit 3 to the end of each step 7, the flight of stairs 1 exhibits an excellent lateral stability since each step 7 is fixed by its two lateral edges and a portion of its front edge, that is along two perpendicular axis. It should be noted that this particular arrangement is not shown in any prior art references of which the Applicant is aware.

Each stringer unit 3 also comprises a fixation plate 27 integrally extending the side plate 11 in a plane that can be identical to the plane of the side plate 11, or, as shown, in a plane extending rearwardly and parallel to the plane of the side plate 11.

In the particular embodiment shown on FIGS. 1 to 6, the fixation plate 27 integrally extends the front lower end of the side plate 11 in a plane extending rearwardly and parallel to the plane of this side plate, this set back position defining a vertical edge 31. The fixation plate 27 extends forwards in front of the side plate 11 so as to come into contact with the surface of the rear upper end of the side plate 11 of the stringer unit 3 which is immediately inferior thereto, just under the horizontal flange 13 of this side plate.

The surface of the fixation plate 27 is provided with two punched holes 29. The surfaces of the side plate 11 and the stringer units 3 with which the fixation plate 27 of the stringer unit 3 immediately superior thereto to come into contact, is also provided with two holes 19 punched in the same direction as the holes 29 and placed in such a manner as to be in cooperative relationship with respect to these holes 29. To improve the rigidity of the assembly and reduce the fabrication cost, the fixation plate 27 and the side plate 11 preferably each comprise two holes. However, it should be mentioned that the number of holes is not an essential feature of the invention and that only one single hole is more than two holes 19 or 29 could be used if desired.

As can be easily understood, the holes 19 and 29 are positioned so as to allow fixation of the stringer units to each other by riveting or bolting.

The fact that the holes 19 and 29 are punched in a very essential feature of the invention. Indeed, as can be clearly understood with particular reference to FIG. 2 the punching of the holes 19 and 29 used for fixing the stringer unit 3 to another stringer unit 3 immediately superior thereto, is of the great interest since it provides engagement of the collars 33 and 35 of the punched holes 19 and 29 one inside the other when the rivets are hammered or the nuts 39 are screwed onto the bolts 37. This engagement is very interesting since it ensures an improved reinforcement of the flight of stairs against the vertical shearing forces that are applied to the connections of each pair of the stringer units when the stairs support a load.

Indeed, it can be easily understood that the collars 33 and 35 of the punched holes 19 and 29 engaged one inside the other, advantageously support the load and transmit this load directly to the side plates 11 of the stringer units instead of transmitting it to the bolts or rivets 37 inserted into these holes. As a result, these bolts or rivets 37 are less and even no more subjected to vertical shearing forces, as these forces act only onto the colars 35 and 37 of the punched holes.

It should be noted that the improved reinforcement of the flight of stairs is furthermore completed by the vertical edge 31 formed at the connection of the fixation plate 27 with the side plate 11 of each stringer unit 3. Indeed, as can be seen on FIG. 2, the rear end of the side plate 11 comes into contact with, and bears against the edge 31 when the bolts or rivets 37 are fixed. This bearing of the lower stringer unit 3 against the upper stringer unit 3 along this edge 31 is particularly interesting since it increases the supporting capacity of the flight of stairs in a very efficient and simple manner.

Advantageously, each stringer unit 3 is made of one single piece. As shown in FIGS. 1 and 3, the lower edge 17 of the side plate 11 is advantageously inclined from the front to the rear of each stringer unit at such an angle that this lower edge 17 extends in line the lower edge 17 of the side plate of the stringer unit immediately superior or inferior thereto once this other stringer unit has been fixed, while dissimulating the fixation plate.

The stringer units 5 that support the first edge of the stairs are structurally identical to the stringer units 3 that are superior thereto except that, on one end, each unit 5 does not comprise a fixation plate as it has not to be fixed to a lower unit and, on the other end, the lower edge 57 of its side plate 51 is not inclined but rather horizontal in order to increase the surface of contact of this stringer unit 5 with the ground or floor on which it lays. Except for these two characteristics, the stringer unit 5 comprises a side plate 51 provided with an upper edge 53 and a front plate 61 provided with an upper edge 63. The upper edges 53 and 63 extend at the same level and are each provided with holes 55 whose function is identical to that of the holes 15 and 25 previously described in connection with the stringer units 3. The stringer unit 5 also comprises, as the stringer unit 3, two punched holes 59 in the rear surface of its plate 51, to allow bolting or riveting of the fixation plate 27 of the stringer unit 3 that is immediately superior thereto.

The above-described, flight of stairs 1 lays by the lower ends of its lower units 5 directly onto the ground S. It is compulsory however that the upper ends of this flight to be fixed to the floor P or to the vertical edge of the floor to which the flight of stairs leads. To allow fixation of the last pair of stringer units 3 and 3' supporting the last step of the stairs to the floor P, use is advantageously made of two holding pieces 9 and 9' each having the shape of a rectangular dihedron having one of its plane 91 provided with two punched holes 99 positioned so as to be in front of the holes 19 of the last stringer units 3 and 3' respectively. Each holding piece 9 is screwed or bolted by its plan 91 provided with a punched holes 99 directly to the side plate 11 of one of the stringer units 3 supporting the last step of the stairs. The holding piece 9 is also fixed by its other plane 93 directly to the vertical edge surface of the floor P at a suitable level. The means used for fixing the plane 93 of the holding piece 9 directly to the vertical edge of the floor P can be of any standard type and accordingly these means will not be described hereinafter in details.

To ease its fixation, the plane 93 can be provided with holes in which the above mentioned fixing means may be inserted. It should be noted that the number of punched holes 99 and the size of the holding pieces 9 of course depend on the number of punched holes and the size of each stringer unit 3. It should further be noted that the holding pieces 9 and 9' are structurally symmetrical and accordingly they do not need be specifically fabricated in view of being used on the left or right side of the stairs, as are the stringer units 3 and 3'.

Figure 4:
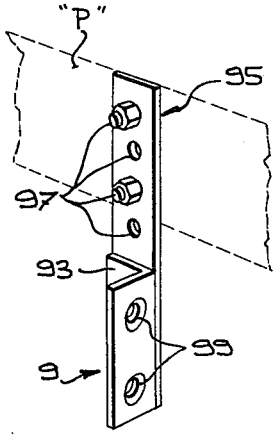
FIG. 4 is a perspective view of the holding piece used for fixing the upper ends of the stairs via a connecting piece.

When the edge of the floor P extends forwards as shown in FIG. 3 and does not allow direct fixation of the plane 93 of each holding piece 9, use can be made of a vertical connecting piece 95 as shown in FIG. 4. This vertical connecting piece 95 consists of a simple, elongated steel plate perforated with holes 97 regularly spaced apart and it can be fixed by means of bolts the plane 93 of the holding piece 9 in order to upwards this plane 93 to the desired level where it can then be fixed to the floor P by any conventional means such as fixation anchors inserted through the holes 97.

It should be noted that the holding pieces 9 that have been described hereinabove, can be used not only for fixing the last pair of stringer units 3 and 3' of the flight of stairs 1 to the floor P, but also for improving the lateral stability of this flight of stair when this is needed. In this case, the pieces 9 are not used anymore for holding the assembly but for reinforcing it.

Figure 6:
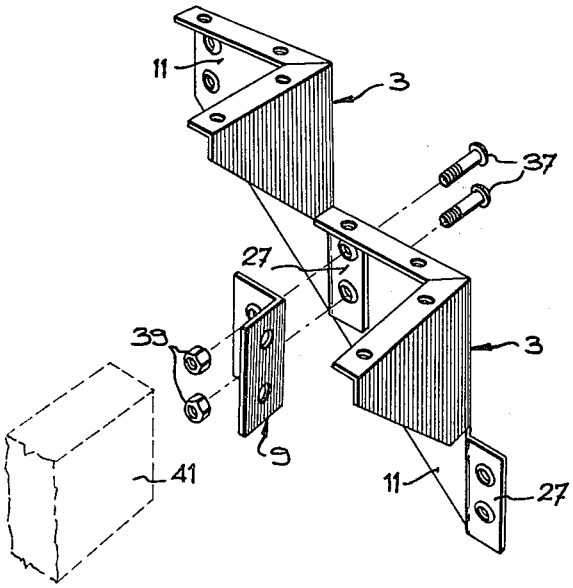
FIG. 6 is a perspective view of the fixation of the reinforcing rod shown on FIG. 5 to a pair of stringer units.

As shown on FIGS. 5 and 6, the lateral stability of the flight of stairs 1 can be reinforced by using two pieces 9 in combination with a horizontal rod or beam 41. The reinforcing pieces 9 are fixed by riveting or bolting their plane provided with punched holes, directly to the fixation plates 27 and the side plates 11 of two pairs of stringers units acting as supports for two adjacent steps at substantially half-way from the top of the stairs or at equal interval. After having been rigidly fixed to the flight of stairs in such a manner as to be orientated towards each other, the reinforcing pieces 9 are then fixed to each other by the rod or beam 41 which then may keep the lateral sides of the flight of stairs 1 in parallel relationship and to avoid that these lateral sides separate from each other or laterally bends. Usually, the lateral stability of both sides of the flight of stairs 1 is obtained by the steps 7. However, the use of one or several holding rod 41 substantially improves the general structural and resistance of the stairs. In order to reduce the cost of fabrication and to simplify the structure of the assembly, the reinforcing and holding pieces are advantageously identical to each other as it has been described hereinabove. However, it could also be made of reinforcing pieces for use in combination with a rod 41, that would be of a general structure and shape different from that of the holding pieces 9 that have been described hereinabove in details.

In a order to make the above-described flight of stairs 1 easy to install, at least one pair of stringer units whose height are adjustable, may be provided in order to compensate any slack that could be produced when assembling the flight of stairs 1 onto the premises or for compensating any recess in the ground or floor onto which the flight of stairs lays. For this purpose, use can be made by way of example, of a pair of stringer units 103 whose general structure and function are identical to the structure and function of the stringer units 3 except that each stringer unit 103 is made of two pieces vertically adjustable with respect to each other instead of being made of one piece. The lower piece of the step 103 comprises a vertical side plate 111 and a vertical front plate 121 forming a rectangular dihedron with the side plate 111. The lower front end of side plate 111 is integrally extended by a fixation plate 127 provided with two punched holes 129, to give to the unit the same structure as that previously described for each one-piece made, stringer unit 3.

The upper piece of the adjustable stringer unit 103 comprises a vertical side plate 111' which is provided with an horizontal upper flange 113, and a vertical front plate 121' forming a rectangular dihedron with a side plate 111'. The front plate 121' is also provided with a horizontal upper flange 123 which extends in the same plane as the horizontal flange 113 of the side plate 111' in order to define together with the flange 113 a rigid L-shaped support very stable in use for supporting one of the step 7.

The vertical plates 111' et 121' are sized to face and come into contact with, the vertical plates 111 et 121 of the lower piece. This particular structure allows vertical sliding of the upper piece of the stringer unit 103 with respect to the lower piece of this unit for increasing or reducing the total front surface defined by the plates 121 and 121' and the total side surface defined by the plates 111 et 111'.

Figure 7:
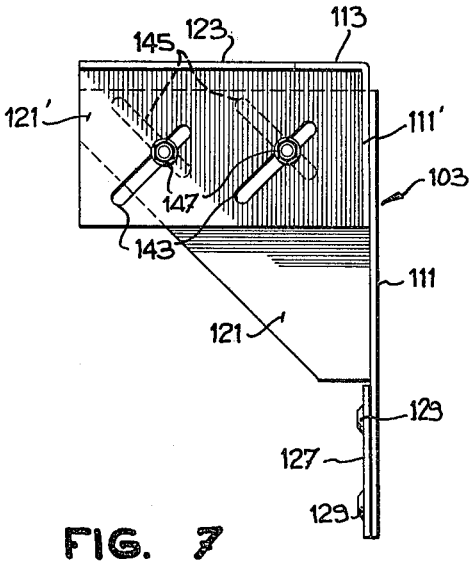
FIG. 7 is a rear elevational view of another embodiment of stringer units according to the invention, of the adjustable type.
Figure 8:
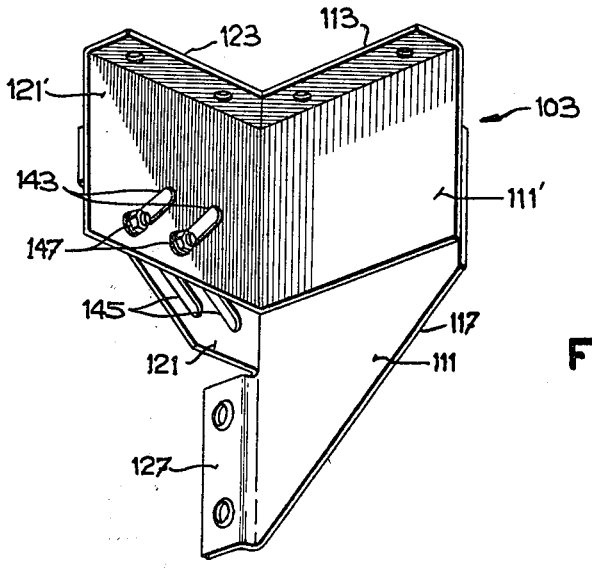
FIG. 8 is a rear perspective view of the stringer units shown on FIG. 7, adjusted in a different manner.

To allow adjustment of both pieces one with respect to the other and their fixation once the suitable height of has been set, a first set of two slots 143 both extending in one inclined direction is provided in the upper piece of the stringer unit 103. Another set of two slots 145 extending in an inclined direction opposite to that of the slot 143 is provided in the lower piece as clearly shown on FIGS. 7 and 8. The two set of slots 143 and 145 are positioned with respect to each other in such manner that the slots of one set comes across the slots of the other set to allow insertion of fixation bolts 147 at their respective crossings.

As can be easily understood, the adjustment of the two pieces one with respect to the other results in a shifting of the crossing zones of the slots 143 and 145. This ensure an automatic compensation in one direction of any movement of the bolts 147 in the other direction along the double slots.

The main advantage of using such a set of double slots is to provide firm holding of both pieces of the stringer unit 103 once these pieces are fixed to each other. Indeed, the inclination of the slots and the fact that each piece is in the shape of a dihedron whose surfaces are parallel and adjacent to the surfaces of the other piece, clauses self both pieces to block automatically.

Figure 9:
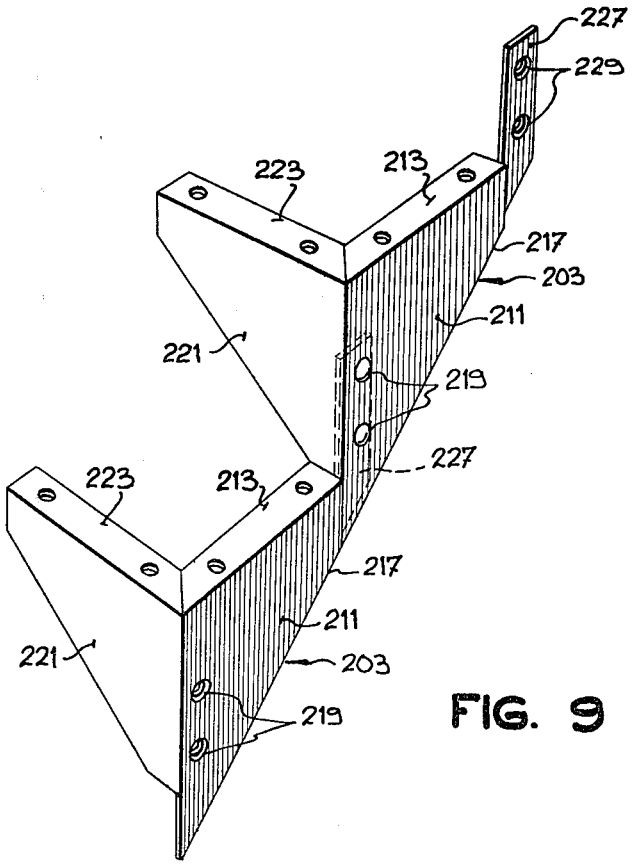
FIG. 9 is a perspective view of another embodiment of stringer units according to the invention.

According to another embodiment of the invention as shown on FIG. 9, use can be made of stringer units 203 whose fixation plate 227 does not extend the front lower end of the side plate but the rear upper end thereof in a plane extending rearwardly.

In this case, the fixation plate 227 extends vertically above the horizontal flange 213 of the side plate 211 of the stringer unit 203 so as to come to contact with the surface of the lower front end of the stringer unit immediately superior thereto.

The general structure, the function and the utility of the stringer units 203 are identical to those of the stringer units 3 previously described with reference to FIGS. 1 to 6 and accordingly these features will not be detailed hereinafter. In this regard, it will be noted that the various numeral references used for identifying each part of the stringer units 203 are identical to the numeral references used for identifying the same parts on the stringer units 3, plus 200.

Figure 10:
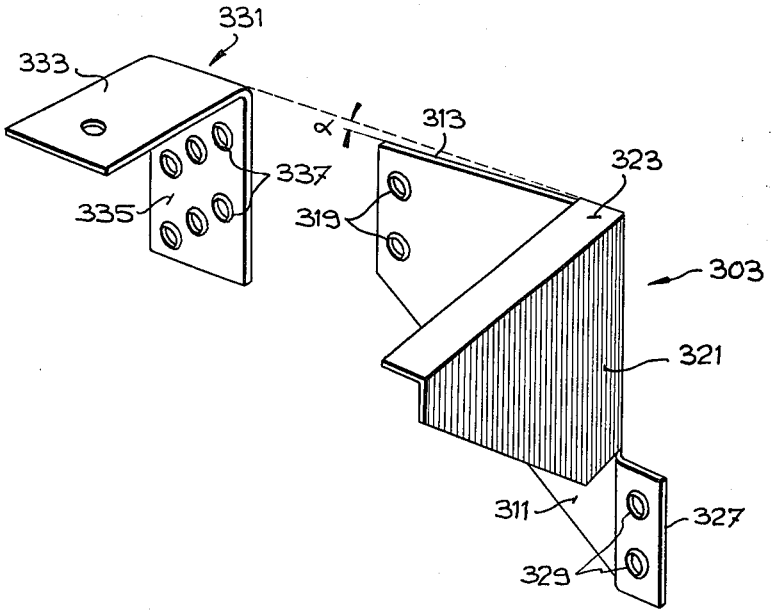
FIG. 10 is a perspective view of a further embodiment of stringer unit according to the invention.

According to another embodiment of the invention as shown on FIG. 10, use can also be made of stringer units 303 whose vertical side plate 311 is not integrally extended by an horizontal upper flange as described hereinabove but is rather cut at angle to define an upper edge 313, which extends slightly downwards to the rear.

To provide lateral support to the step, an easily, attachable, support member 331 is used. This member 331 comprises a vertical plate 335 provided with at least two and preferably three pairs of punched holes 337 positioned in such a manner that each pair of holes 337 is vertically spaced part with respect to each other(s) and is connectable to the pair of holes 319 used for attaching the stringer unit 303 to the one immediately superior thereto. The member 331 also comprises an horizontal plate 333 integrally extending the vertical plate 335, for supporting the end of the step that will be mounted onto the stringer. This horizontal plate may be provided with a hole to ease the fixation of the step, as shown on FIG. 10.

In operation, the members 331 are rigidly attached to their respective stringer units to provide rigid supports to the steps and laterally reinforce the stairs in the same manner as the upper flanges of the side plates 311 would do. This attachment is carried out by application of the member plate 335 against the plate 311 of the unit with one selected pair of holes 337 in front of the holes 319 (and 329) and introduction of the fixation bolts used for fixing the stringer units together through the holes 337, 329 and 319.

As can therefore be understood, this particular embodiment does not require any additional elements for attaching or fixing the structural members of the stringer units altogether. Moreover, this particular embodiment advantageously makes the level of each step adjustable whenever necessary, thanks to the various pairs of holes 337 that do not extend at the same level and may therefore be selected to raise or lower the rear parts of the steps whenever is necessary.

Of course, further modifications could be made to the above described preferred embodiment to the present invention within the scope of the following claims.

We claim:

1. A stringer unit for the fabrication of a modular, self-supporting flight of stairs, said unit comprising:

a vertical side plate provided with an horizontal, upper flange;

a vertical front plate defining a rectangular dihedron with the side plate, said front plate being also provided with an horizontal, upper flange defining together with the upper flange of the side plate, a rigid L-shaped support very stable in use for supporting one end of a step thread; and a small fixation plate integrally extending the side plate in the same plane as, or in a plane parallel to, the plane of said side plate, said fixation plate being so positioned as to come into contact with the surface of the side plate of another, upper or lower stringer unit, the surface of the fixation plate and the surface of the side plate of the unit with which the fixation plate of a further, upper or lower stringer unit comes into contact, being each provided with at least one punched hole positioned in such a manner as to be in front of a corresponding hole punched in the same direction through the surface of the fixation plate or the surface of the side plate of said further upper or lower stringer unit for allowing riveting or bolting of said further unit to said unit, said punching of the holes ensuring some kind of engagement of the holes one inside the other during the riveting or bolting step and thus an improved reinforcement of the flight against the vertical shearing forces.

2. A stringer unit as defined in claim 1, wherein the fixation plate integrally extends the rear upper end of the lateral side in a plane extending rearwardly and parallel to the plane of said said plate, said fixation plate extending vertically above the upper edge of said side plate so as to come into contact with the surface of the lower front end of the stringer unit immediately superior thereto.

3. A stringer unit as defined in claim 2, wherein the surface of the fixation plate and the surface of the front lower end of the side plate with which the fixation plate of the stringer unit immediately inferior to the unit comes into contact, are each provided with two punched holes vertically arranged one above the other.

4. A stringer unit as defined in claim 1, wherein the fixation plate integrally extends the front lower end of the side plate in a plane extending rearwardly and parallel to the plane of the side plane, said fixation plate extending in front of the side plate so as to come into contact with the surface of the rear upper end of the side plate of the stringer unit immediately inferior thereto, just under the upper flange thereof.

5. A stringer unit as defined in claim 4, wherein the surface of the fixation plate and the surface of the rear upper end of the side plate with which a fixation plate of another stringer unit immediately superior thereto comes into contact, are each provided with two punched holes vertically disposed one above the other.

6. A stringer unit as defined in claim 1, 3 or 5, which is made of one single piece and wherein the lower edge of the side plate is upwardly inclined from the front to the rear of the unit at such an angle that said lower edge extends in line the lower edge of the side plate of another stringer unit immediately superior or inferior thereto when said other stringer unit has been fixed, while dissimulating the fixation plate.

7. A stringer unit as defined in claim 1, 3 or 5, which is made of two separate pieces vertically adjustable with respect to each other in order to allow adjustment of the total height of each step, said two pieces being each provided with a set of double slots, said two pieces being connected to each other by a pair of bolt-and-nuts screwed at the intersection of the sets of slots, the set of double slots of the upper piece extending in one inclined direction opposite to that of the set of double slots of the lower piece so that any movement of the bolts in one direction be automatically compensated by a corresponding movement of said bolts in the other direction along the other set of double slots of the lower piece.

8. A modular, self-supporting flight of stairs comprising at least two pairs of stringer units as defined in claim 1, each pair acting as a support for a thread-step, the stringer units of each pair being fixed to the corresponding stringer units of the other pair which is immediately inferior or superior thereto by riveting or bolting the fixation plates of the units of one pair to the side plates of the units of the other pair, respectively.

9. A flight of stairs as defined in claim 8, further comprising two holding pieces each in the shape of a rectangular dihedron having one of its plane provided with at least one punched hole, said holding pieces being fixed by their planes provided with at least one punched hole, to the fixation plates or side plates of the stringer units supporting the upper step of the stairs, said holding pieces firmly maintaining the upper end of said stairs onto a suitable support by fixation of their other planes onto said support.

10. A flight of stairs as defined in claim 9, wherein the other planes of the holding pieces used for maintaining the upper end of the stairs are each fixed onto the support-through a vertical connecting piece.

11. A flight of stairs as defined in claim 9, further comprising at least two reinforcing pieces each in the shape of the rectangular dihedron having one plane provided with at least one punched hole, said reinforcing pieces being fixed by riveting or bolting their planes provided with at least one punched hole, simultaneously to the fixation plates and side plates of two pairs of stringer units attached to each other, said reinforcing pieces laterally reinforcing the flight of stairs by fixation of their other plates to the ends of a horizontal rod or beam extending across the stairs.

12. A flight of stairs as defined in claim 11, wherein the reinforcing pieces and the holding pieces are structurally identical and interchangeable.

13. A flight of stairs as defined in claim 9, wherein the fixation plate of each unit integrally extends the front lower end of the side plate of said unit in a plane extending rearwardly and parallel to the plane of said side plate, said fixation plate extending in front of the side plate so as to come into contact with the surface of the rear upper end of the side plate of the stringer unit immediately inferior thereto just under the upper flange thereof, the surfaces of said fixation plate and of the rear upper end of the side plate with which the fixation plate of the other stringer unit immediately superior thereto comes into contact, being each provided with two punched holes vertically disposed one above the other.

14. A flight of stairs as defined in claim 8, 9 or 13, wherein the stringer units of each pair are symmetrical with respect to a vertical plane passing through the middle of the stairs, the front side of each unit extending towards the middle of the stairs.

15. A flight of stairs as defined in claim 8, 9 or 13, wherein the stringer units of at least one pair of stringer units used for supporting a step, are both adjustable in height.

* * * * *